US005404805A

United States Patent [19]

Fujimoto et al.

[11] Patent Number: 5,404,805

[45] Date of Patent: Apr. 11, 1995

[54] PAPER EJECTION DEVICE FOR A STENCIL PRINTING DEVICE

[75] Inventors: Yasuhiro Fujimoto; Shinichi Takahira; Yuji Satoh, all of Tokyo, Japan

[73] Assignee: Riso Kagaku Corporation, Tokyo, Japan

[21] Appl. No.: 195,505

[22] Filed: Feb. 14, 1994

[30] Foreign Application Priority Data

Feb. 15, 1993 [JP] Japan ..... 5-025791

[51] Int. Cl.[6] ..... B41L 13/00

[52] U.S. Cl. ..... 101/118; 101/2; 271/308; 271/176; 271/184; 271/188; 355/311; 355/315

[58] Field of Search ..... 101/114, 116, 117, 118, 101/2; 271/4, 6, 307, 308, 312, 176, 184, 185, 188, 161; 355/311, 315

[56] References Cited

U.S. PATENT DOCUMENTS

| | | | |
|---|---|---|---|
| 809,287 | 1/1906 | Dick | 101/118 |
| 862,452 | 8/1907 | Dick | 271/188 |
| 2,783,043 | 2/1957 | Tomlin | 271/188 |
| 3,934,872 | 1/1976 | Honkawa | 271/188 |
| 4,712,786 | 12/1987 | Looney | 271/188 |
| 5,098,083 | 3/1992 | Miyoshi et al. | 271/188 |
| 5,165,338 | 11/1992 | Okazaki et al. | 101/118 |
| 5,237,381 | 8/1993 | Hamada | 271/188 |

FOREIGN PATENT DOCUMENTS

| | | | |
|---|---|---|---|
| 0031464 | 2/1985 | Japan | 271/188 |
| 0185763 | 8/1988 | Japan | 271/188 |
| 0185772 | 8/1988 | Japan | 271/188 |
| 3-143864 | 6/1991 | Japan | 271/188 |
| 4-045942 | 2/1992 | Japan | 271/188 |
| 4-064568 | 2/1992 | Japan | 271/188 |

OTHER PUBLICATIONS

Xerox Disclosure Journal, vol. 6, No. 5, Sep./Oct. 1981, pp. 237–238, Kobus, S. "Variable Sheet Deflector For Document Restacking".

Patent Abstracts of Japan, vol. 13, No. 392(M-865) 30 Aug. 1989 (JP-A-01 139 465) May 31, 1989.

Patent Abstracts of Japan, vol. 11, No. 54 (M-563) 19 Feb. 1987 (JP-A-61 217 461) Sep. 27, 1986.

*Primary Examiner*—Eugene H. Eickholt

*Attorney, Agent, or Firm*—Dickstein, Shapiro & Morin

[57] ABSTRACT

In a paper ejection device for a stencil printing device provided with a lifting member for producing a curvature in each sheet of ejected printing paper as seen in a cross section perpendicular to the direction of paper ejection, the lifting member is allowed to move at least between a first position which is relatively retracted from the paper ejection passage and a second position which relatively protrudes into the paper ejection passage. The movement of the lifting member may be effected according to the size or the kind of the printing paper or depending on whether a sorter is connected to the printer or not. Thus, an appropriate curvature can be given to the ejected printing paper without requiring any manual work by the user. Thus, a satisfactory paper ejecting operation can be ensured at all times without requiring any manual work by the operator of the stencil printing device.

7 Claims, 11 Drawing Sheets

PAPER EJECTION DEVICE FOR A STENCIL PRINTING DEVICE

TECHNICAL FIELD

The present invention relates to a paper ejection device for a stencil printing device, and in particular to a paper ejection device provided with a means for producing a curvature in each ejected printing paper as seen in a cross section perpendicular to the direction of paper ejection.

BACKGROUND OF THE INVENTION

In the conventional stencil printing device, printed printing paper is ejected from a printing unit, and is stacked up on a paper ejection table provided in a terminal end of a paper ejection passage, with its printed face up.

If the leading edge of the printing paper droops down as the paper sheet is conveyed to the paper ejection table, the leading edge of the printed printing paper may slide over the upper surface or the printed surface of the paper sheet previously stacked up on the paper ejection table, and this will smear the printed image of the printed printing paper previously placed on the paper ejection table. Therefore, it is proposed, for instance, in Japanese patent publication (kokoku) No. 58-46428, Japanese utility model laid open publication (kokai) No. 60-165347 and Japanese patent laid open publication (kokai) No. 61-217461, to increase the apparent rigidity of the printing paper along the direction of paper ejection (the longitudinal direction) and prevent the leading edge of the printing paper from drooping during the process of paper ejection by providing a lifting member in an intermediate part of the paper ejection passage leading to the paper ejection table and providing a U-shaped or W-shaped curvature to the printing paper as seen in the cross section perpendicular to the direction of paper ejection.

However, the inventors have realized that the effective rigidity of printing paper heavily depends on the thickness, material and size of the printing paper, and that the curvature that should be given to the printing paper for achieving a desired apparent rigidity varies a great deal depending on the type and size of the printing paper. In particular, it has been realized that a fixed lifting member is not adequate in ensuring a Satisfactory operation of the paper ejection device when printing paper of different types and sizes is used on the stencil printing device.

For instance, the effective rigidity of printing paper heavily depends on the size, in particular the lateral width of the printing paper, and it is therefore desirable to determine the degree of the curvature according to the lateral width of the printing paper or the dimension of the printing paper in the direction perpendicular to the direction of paper ejection.

Also, printing paper of a relatively small thickness has a relatively low rigidity, and therefore requires a greater curvature for it to be provided with a required rigidity along the direction of paper ejection or for it to be prevented from drooping. On the other hand, when the printing paper has a relatively large thickness, it already has an almost sufficient rigidity by itself, and, therefore, is not required to be given with a large curvature. As a matter of fact, it is not desirable to give the printing paper a greater curvature than required because it may be detrimental in smoothly ejecting printed printing paper.

In some stencil printing devices, the terminal end of the paper ejection passage is optionally connected to a sorter including a means for positively conveying printing paper such as a belt conveyer instead of a paper ejection table for sorting a plurality of copies made from multiple page originals.

In such a stencil printing device, the lifting member can effectively act upon the ejected printing paper when paper ejection is made onto a paper ejection table. However, when a sorter is connected to the stencil printing device, producing a curvature in the ejected printing paper by means of a lifting member may prevent the positive printing paper feeding means in the sorter from carrying out a satisfactory conveying action, and may cause paper jamming in the sorter.

According to the conventionally known paper ejection device, the lifting member is either fixedly mounted or detachably mounted. When the lifting member is fixedly mounted, it is not possible to readily change the height of the lifting member or to replace the lifting member. When the lifting member is detachably mounted, the user could change the height of the lifting member by replacing it with another. However, as it is normally carried out by the user, the replacing of the lifting member may not be carried out in an appropriate manner. In particular, when the replacement of the lifting member is not appropriately carried out so as to be compatible with the presence of a sorter, an even worse result can be produced.

Furthermore, since the replacement of the lifting member is carried out manually, the work involved may not be slight, and it may impose a serious burden on the user. This is a major factor in reducing the market acceptability of the stencil printing paper as a piece of equipment that is to be widely used in office environments.

BRIEF SUMMARY OF THE INVENTION

In view of such problems of the prior art, a primary object of the present invention is to provide an improved paper ejection device for a stencil printing device provided with a means for producing a curvature in each sheet of ejected printing paper as seen in a cross section perpendicular to the direction of paper ejection which is capable of giving an appropriate curvature to the ejected printing paper without requiring any manual work by the user.

A second object of the present invention is to provide such a paper ejection device provided with a means for giving a curvature to the ejected printing paper which can automatically adapt itself to different types, sizes, materials and other properties of the ejected printing paper.

A third object of the present invention is to provide such a paper ejection device provided with a means for giving a curvature to the ejected printing paper which can automatically adapt itself to the presence of a sorter that can be optionally connected to a terminal end of the paper ejection passage.

A fourth object of the present invention is to provide such a paper ejection device provided with a means for giving a curvature to the ejected printing paper which can ensure a stable paper ejection operation at all times without regard to various external factors.

These and other objects of the present invention can be accomplished by providing a paper ejection device for a stencil printing device, comprising: a lifting member provided in an intermediate part of a paper ejection passage of the stencil printing device for producing a curvature in each sheet of printing paper as seen in a cross section perpendicular to the direction of paper ejection; lifting member support means for supporting the lifting member in a substantially vertically moveable manner at least between a first position which is retracted from the paper ejection passage and a second position which protrudes into the paper ejection passage; drive means for moving the lifting member at least between the first and second positions; and control means for controlling the operation of the drive means according to a signal supplied from information receiving means.

Thus, the lifting member may be moved to an appropriate position according to the information supplied from the information receiving means, and a satisfactory paper ejecting operation can be ensured at all times without requiring any manual work by the operator of the stencil printing device.

The information which determines the suitable position of the lifting member may be derived from various sources. For instance, the information receiving means may comprise a manual switch adapted to be used by the operator of the stencil printing device according to his judgement. Alternatively, the manual switch may be incorporated in a paper type selection switch and/or a paper size selection switch of the stencil printing device so that the position of the lifting member may be determined in a more automated fashion.

According to a preferred embodiment of the present invention, the information receiving means comprises a sensor for detecting the type and/or the size of a sheet of printing paper that is to be ejected from the stencil printing device.

If the stencil printing device consists of a type which can be optionally equipped with a sorter, the information receiving means may comprise a sorter sensor for detecting whether a sorter is connected to the paper ejection passage or not so that the driving means may move the lifting member to the first position when a sorter is connected to the paper ejection passage and to the second position when a sorter is not connected to the paper ejection passage.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
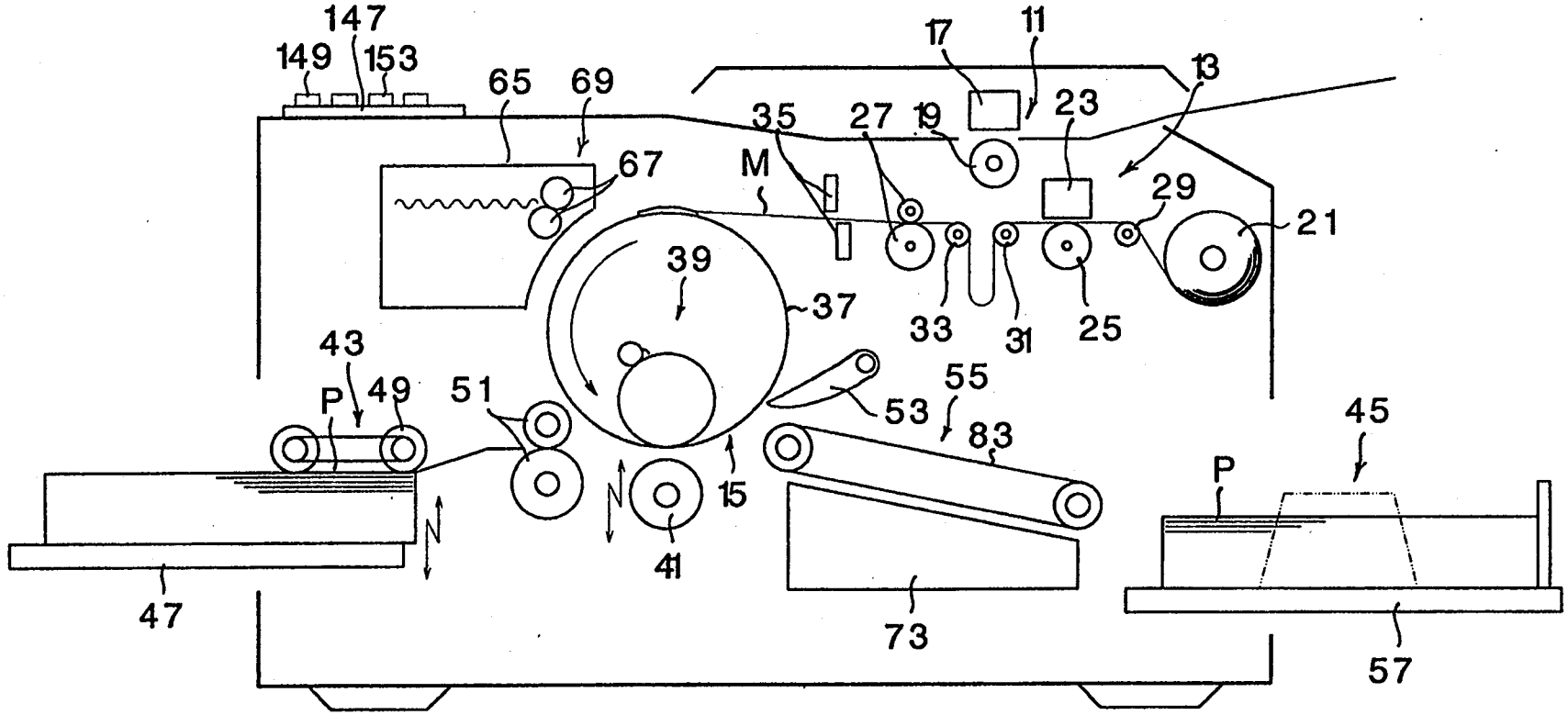
FIG. 1 is a schematic diagram showing an example of a stencil printing device equipped with the function of making master plates which is suitable for employing the paper ejection device according to the present invention when no sorter is connected to the stencil printing device.

FIG. 1 shows an example of a stencil printing device having the function of making printing master plates. The illustrated stencil printing device having the function of making printing master plates comprises an original reading unit 11, a plate making unit 13, and a printing unit 15.

The original reading unit 11 comprises a line image sensor 17 for reading an original as it is being conveyed in a secondary scanning direction, and an original feeding roller 19.

The plate making unit 13 comprises a master plate sheet roll unit 21, a thermal head 23 consisting of a plurality of dot-like heat generating elements arranged laterally in a single row, master plate sheet feeding rollers 25 and 27, master plate sheet guiding rollers 29, 31 and 33, and a master plate sheet cutter 35 so that a plate making based on a dot matrix thermal perforation is carried out on a heat-sensitive stencil master plate sheet M by selectively and individually heating the plurality of dot-like heat generating elements included in the thermal head 23, and the stencil master plate sheet M is cut by the cutter 35.

The printing unit 15 comprises a printing drum 37 having an ink permeable porous structure, an ink supplying device 39 arranged inside the printing drum 37, and a press roller 41, and a processed stencil master plate sheet M is wrapped around the outer circumferential surface of the printing drum 37.

A paper feeding unit 43 is provided on one end of the printing unit 15, and a paper ejection unit 45 is provided on the other end of the printing unit 15.

The paper feeding unit 43 comprises a paper feeding table 47 for stacking up printing paper, paper feeding rollers 49 for taking out the printing paper P from the paper feeding table 47 sheet by sheet, and timing rollers 51 for delivering the printing paper P to the nip between the printing drum 37 and the press roller 41.

Figure 2:
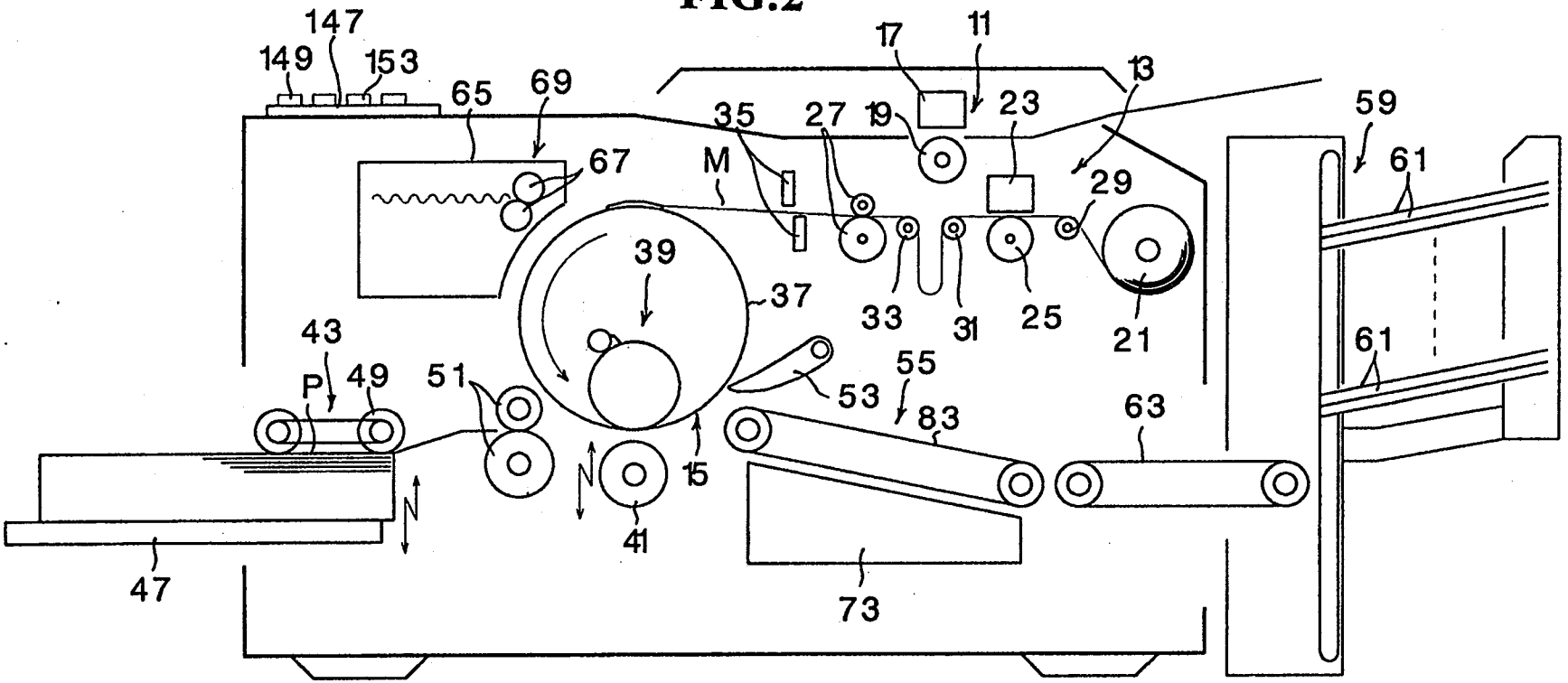
FIG. 2 is a schematic diagram showing the stencil printing device equipped with the function of making master plates which is suitable for employing the paper ejection device according to the present invention when a sorter is connected to the stencil printing device.

The paper ejection unit 45 comprises a peeling claw 53 for removing the printing paper P from the printing drum 37, and a paper ejection device 55. The terminal end of the paper ejection device 55 can be selectively connected either to the paper ejection table 57 for stacking printed printing paper P thereon as illustrated in FIG. 1 or to a sorter 59 as illustrated in FIG. 2.

The sorter 59 consists of a vertically moveable bin type sorter having a normal structure, and comprises a belt conveyer 63 which receives the printing paper P ejected and conveyed by the paper ejection device 55 and positively conveys the printing paper to a selected one of a plurality of bins 61.

At one end of the printing unit 15 is provided a master plate ejection unit 69 including master plate ejection rollers 67 for removing the used stencil master plate sheet M from the printing drum 37 and delivering it into the master plate ejection box 65.

In this stencil printing device, the printing drum 37 is rotatively driven by rotary drive means not shown in the drawings in counter clockwise direction as seen in the drawing around an axial center line thereof, and printing paper P is supplied to the nip between the printing drum 37 and the press roller 41 by the timing rollers 51 which convey the printing paper P from left to right as seen in FIG. 1 so that the printing paper P is pushed against the stencil master plate M mounted around the outer circumferential surface of the printing drum 37 by the press roller 41, and a desired stencil printing is carried out on the printing paper P. The printed printing paper P is removed from the printing drum 37 by the peeling claw 53, and is conveyed to the paper ejection table 57 by the paper ejection device 55 before it is finally stacked on the paper ejection table 57 with its printed face up or conveyed to the sorter 59 as the case may be.

Figure 3:
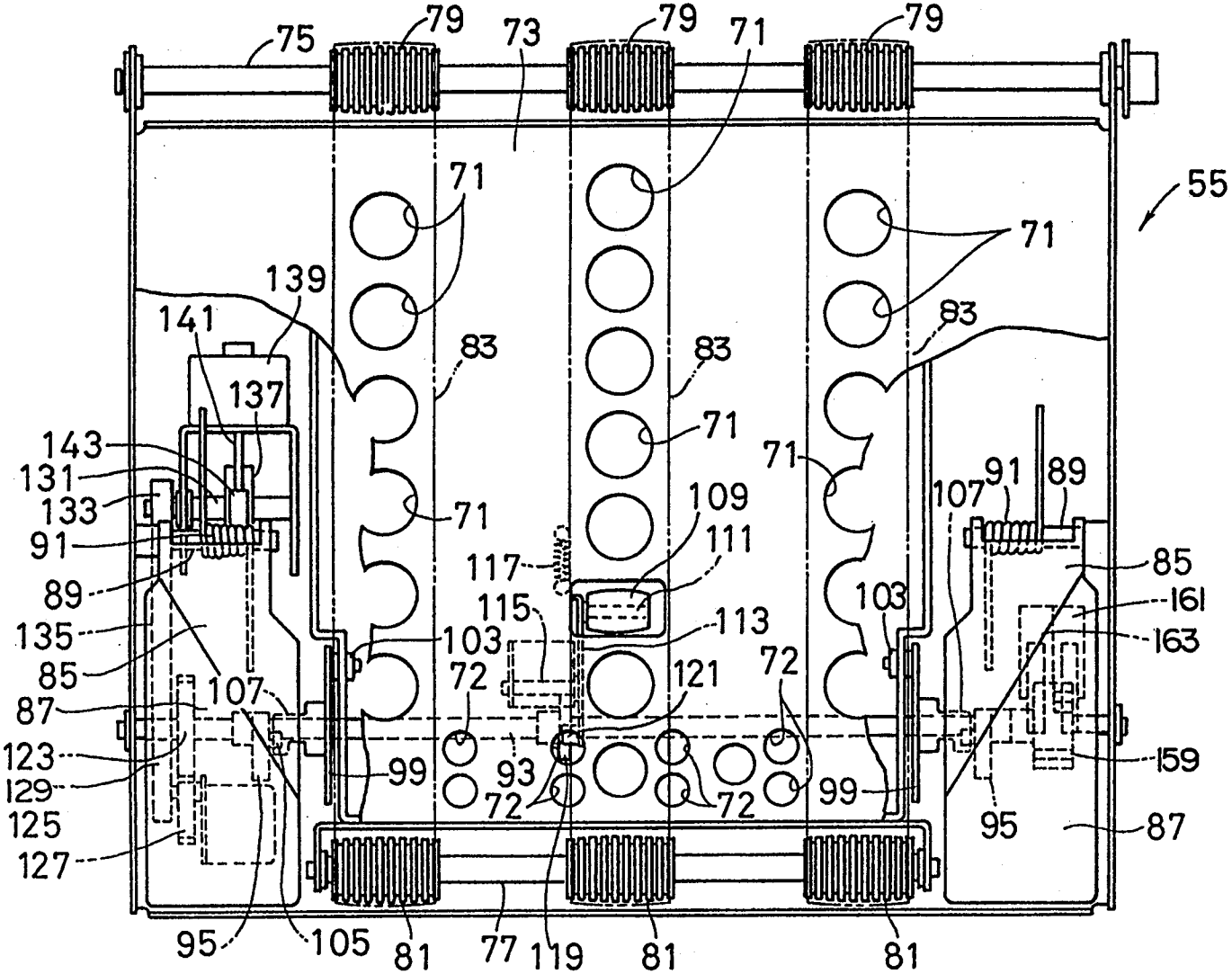
FIG. 3 is a plan view showing an embodiment of the paper ejection device for a stencil printing device according to the present invention.
Figure 4:
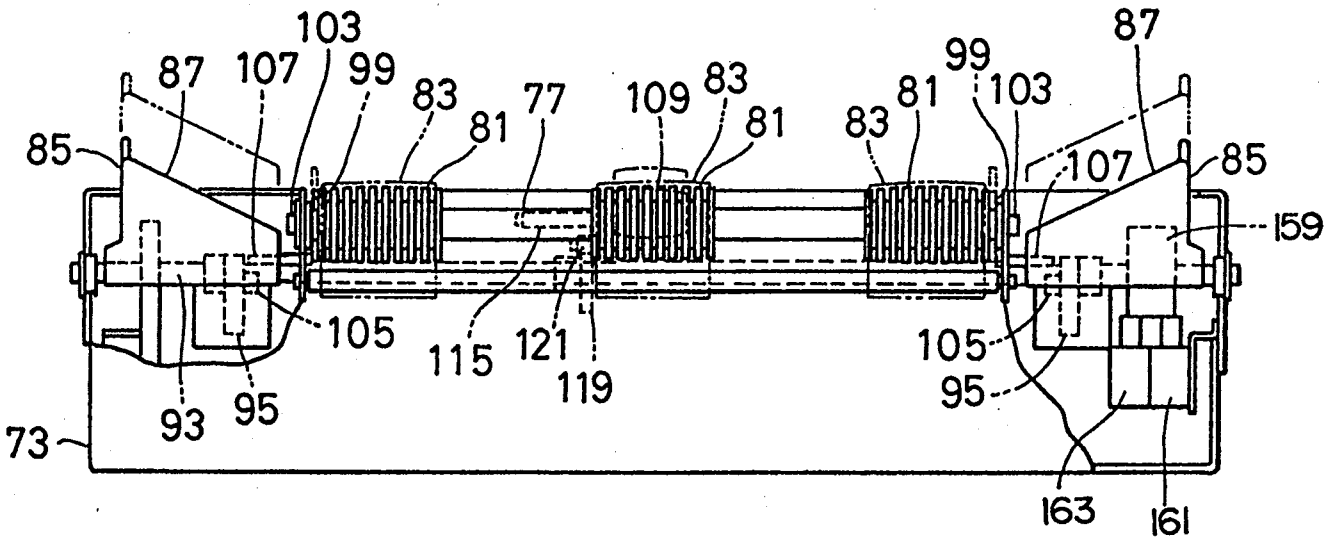
FIG. 4 is a front view showing the paper ejection device for a stencil printing device according to the present invention.
Figure 5:
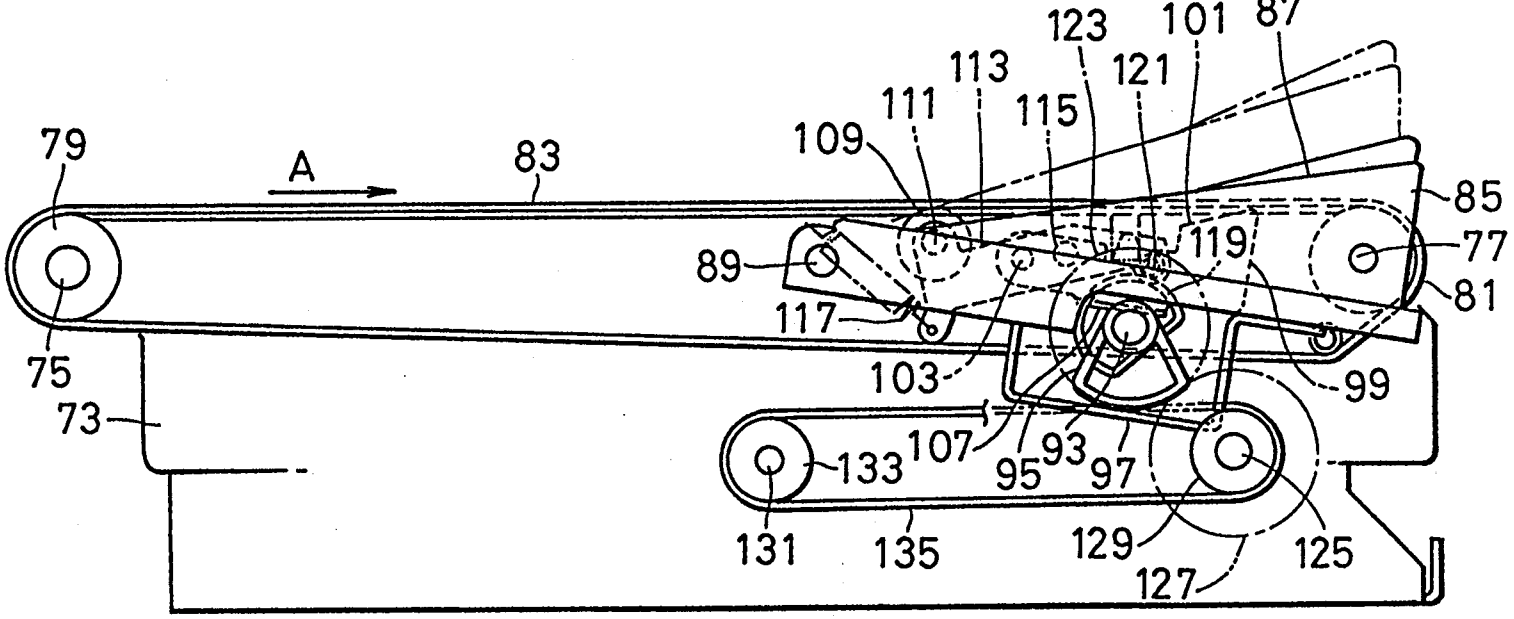
FIG. 5 is a side view showing the paper ejection device for a stencil printing device according to the present invention in its first state.

The paper ejection device of the present invention is applied as the above described paper ejection device 55, and the preferred embodiment thereof is illustrated in FIGS. 3 through 5. The paper ejection device 55 comprises a suction box 73 having a plurality of suction holes 71 on its upper surface.

The suction box 73 is provided with a pair of pulley shafts 75 and 77 at its two ends along the direction of paper ejection (two lateral ends as seen in FIG. 5) in mutually parallel relationship and in a rotatable manner, and each of the pulley shafts 75 and 77 carries three pulleys 79 and 81, respectively. An endless belt 83 made of such material as rubber is passed across each associated pair of the pulleys 79 and 81. The three endless belts 83 thus extend in mutually parallel and spaced relationship along the direction perpendicular to the paper feeding direction or in the lateral direction (this direction is referred to as lateral direction in the following description), in the central and two lateral ends of the suction box 73. The upper span of each endless belt 83 extends along the upper surface of the suction box 73 with a certain small gap defined therebetween, and travels along the upper surface of the suction box 73 in the direction indicated by the arrow A (FIG. 5) as the pulleys 79 are rotatively driven by a drive device not shown in the drawing in clockwise direction as seen in FIG. 5.

Each of the endless belts 83 is provided with a plurality of openings although it is not shown in the drawings, and the printing paper P carried on the upper span of the endless belt 83 is pushed against the upper span of the endless belt 83 by suction as any one of the suction holes 71 coincides with an appropriate part of the endless belt 83.

A pair of primary lifting members 85 are arranged on either lateral end of the terminal end of the suction box 73 as seen in the direction of paper ejection. Each of the primary lifting members 85 is provided with a three-dimensionally contoured inclined guiding surface 87 having an upward inclination which becomes progressively greater towards the associated lateral external end (laterally external end as seen in FIG. 4), and is substantially vertically rotatably supported by a horizontal shaft 89 extending in the lateral direction at its one end and urged in counter clockwise direction or upward as seen in FIG. 5 by a torsion coil spring 91.

A cam shaft 93 is passed laterally across the terminal end of the suction box 73 as seen in the direction of paper ejection in a rotatably manner, and each end of the cam shaft 93 carries a sector-shaped primary lifting member drive cam 95 in an integral manner. Each of the primary lifting member drive cams 95 engages with an engagement portion 97 of the associated one of the primary lifting members 85 so that the primary lifting members 85 are driven between the lower positions indicated by the solid lines in FIGS. 4 and 5, and the upper positions indicated by the imaginary lines in FIGS. 4 and 5 as the cams 95 are rotatively driven.

A secondary lifting member 99 is provided adjacent each primary lifting member at a slightly more inner position. Each of the secondary lifting members 99 is provided with an upwardly inclined guide surface 101 which rises toward the terminal end of the direction of paper ejection, and is substantially vertically rotatable manner by a horizontal shaft 103 extending in the lateral direction at its one end.

Figure 6:
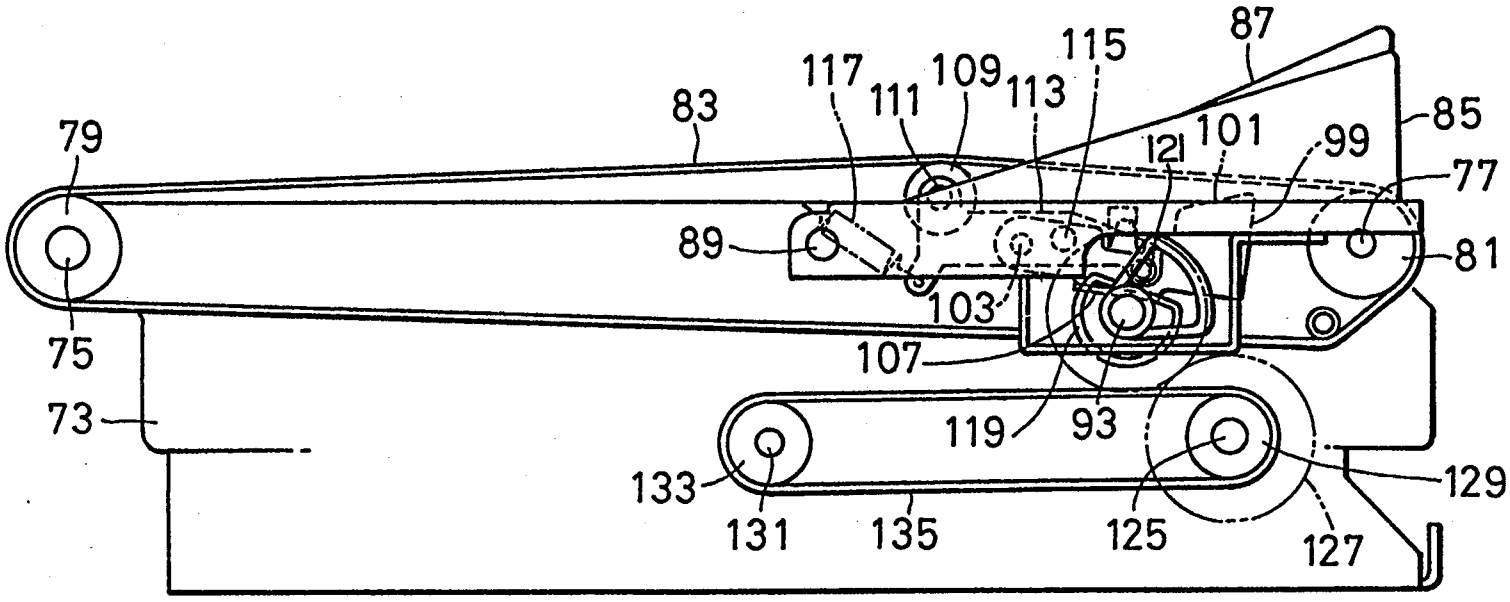
FIG. 6 is a side view showing the paper ejection device for a stencil printing device according to the present invention in its second state.
Figure 7:
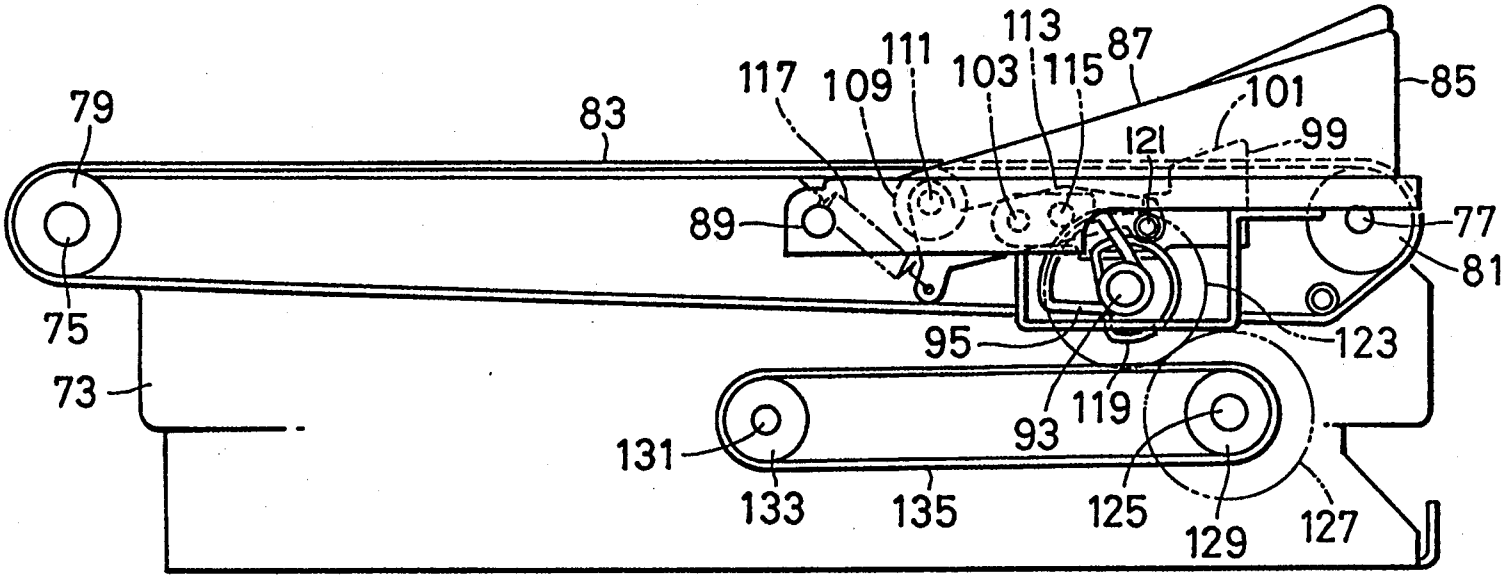
FIG. 7 is a side view showing the paper ejection device for a stencil printing device according to the present invention in its third state.

To each lateral end of the cam shaft 93 is fixedly secured a secondary lifting member drive cam 105 having a semi-circular shape which engages with a cam engagement piece 107 provided in an associated one of the secondary lifting members 99 so that the two secondary lifting members 99 are rotatively driven between their lower positions indicated in FIG. 6 and their upper positions indicated in FIG. 7 as the cam shaft 93 rotates.

A laterally central part of the terminal end of the suction box 73 as seen in the direction of paper ejection is provided with a central lifting roller 109 which is rotatably supported by a pivot shaft 111 carried by a roller support arm 113 at a position immediately below the upper span of the central endless belt 83. The roller support arm 113 is supported by a horizontal shaft 115 extending laterally at an intermediate point thereof in a substantially vertically rotatable manner, and is urged in clockwise direction as seen in FIG. 7 by a tension coil spring 117.

To a central part of the cam shaft 93 is fixedly secured a roller support arm drive cam 119 having the shape of letter-D which engages with a cam follower roller 121 provided in the roller support arm 113 so that the roller support arm 113 can move between its lower position indicated in FIG. 5 and its upper position indicated in FIG. 6 as the cam shaft 93 rotates. The central lifting roller 109 is spaced from the upper span of the central endless belt 83 as indicated in FIG. 5 when the roller support arm 113 is at its lower position, and lifts the upper span of the central endless belt 83 as illustrated in FIG. 6 when the roller support arm 113 is located at its upper position.

So that the printing paper P which is being ejected may be curved in the manner of letter-W (refer to FIG. 9) when the upper span of the central endless belt 83 is lifted by the roller support arm 113, secondary suction holes 72 are provided between the central endless belt 83 and each of the endless belts 83 located on either lateral side thereof at the terminal end of the suction box 73 as seen in the direction of paper ejection.

The primary lifting member drive cams 95, the secondary lifting plate drive cams 105, and the roller support arm drive cam 119 are mounted on the cam shaft 93 in such an angular phase relationship that the primary lifting members 85, the secondary lifting plates 99 and the roller support arm 113 are all at their lower positions as shown in FIG. 5 (first state) when the cam shaft 93 is at its first angular position, the primary lifting members 85 and the roller support arm 113 are placed at their upper positions while the secondary lifting plates 99 are placed at its lower position as shown in FIG. 6 (second state) when the cam shaft 93 is at its second angular position, the primary lifting members 85 and the secondary lifting plates 99 are placed at their upper positions while the roller support arm 113 is placed at its lower position as shown in FIG. 7 (third state) when the cam shaft 93 is at its third angular position.

To the cam shaft 93 is fixedly secured a gear 123 which meshes with another gear 127 carried by an intermediate shaft 125. The intermediate shaft 125 is drivingly connected to a worm wheel shaft 131 by way of an endless belt 135 passed around a pulley 129 carried by the intermediate shaft 125 and another pulley 133 carried by the worm wheel shaft 131. The worm wheel shaft 131 further carries a worm wheel 137 which meshes with a worm 143 carried by an output shaft 141 of a cam drive motor 139 and rotatively driven by the cam drive motor 139. As a result, the cam shaft 93 can be selectively rotated to any one of the first, second and third angular positions by the cam drive motor 139.

Figure 8:
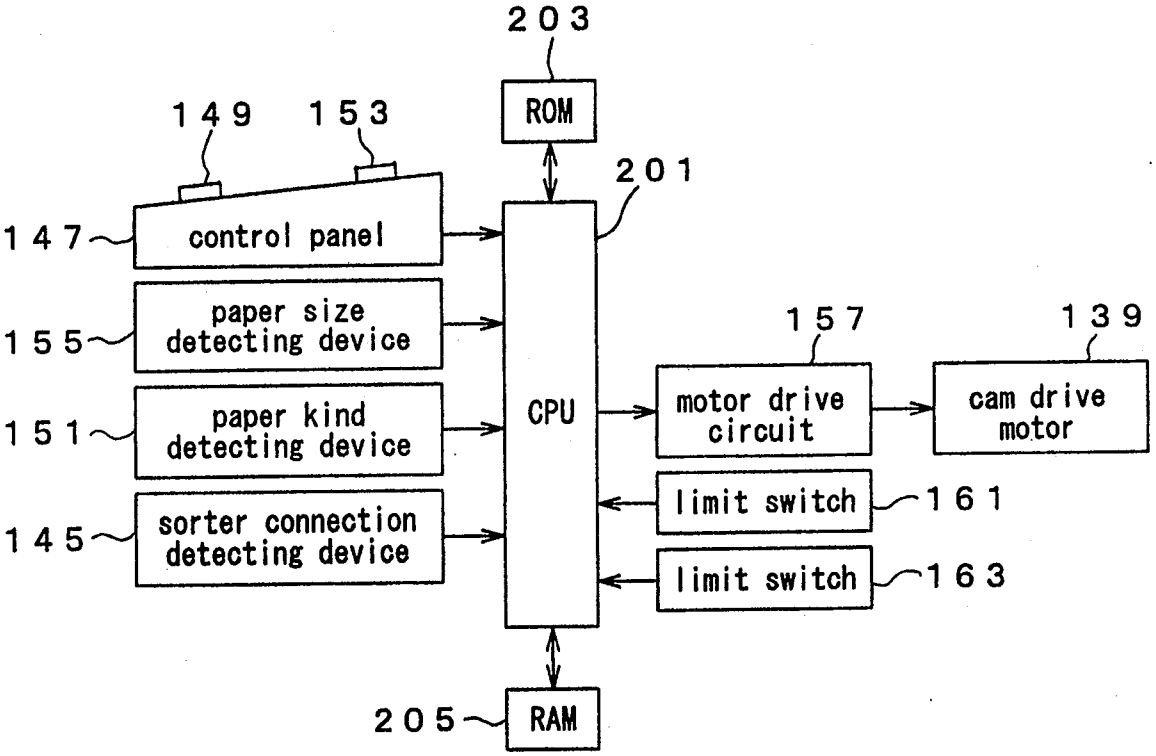
FIG. 8 is a block diagram showing an embodiment of the control system for the paper ejection device for a stencil printing device according to the present invention.

FIG. 8 shows an embodiment of the control system for the cam drive motor 139. This control system comprises a CPU 201, ROM 203 for storing a system program and data files containing control commands for controlling the operation of the cam drive motor 139 which are pre-defined depending on whether a sorter 59 is connected or not, as well as for different paper types and paper sizes, and RAM 205 for temporarily storing input information.

In this case, the control commands for the cam drive motor 139 are defined in such a manner that when no sorter is connected to the printing device, the first state is selected when the printing paper P consists of standard paper of normal weight and of the A3 size, the second state is selected when the printing paper consists of standard paper of normal weight and of a size smaller than the A3 size but greater than the A4 size, the third state is selected when the printing paper consists of standard paper of normal weight and of a size smaller than the A4 size, and the first state is selected when the printing paper consists of relatively thick paper having an increased rigidity without regard to the size of the paper. Further, the first state is selected when a sorter 59 is connected to the printing device without regard to the kind of the paper and the paper size.

The CPU 201 receives information on whether a sorter 59 is connected or not from a sorter connection detecting switch 145 provided in a sorter connecting portion, information on the kind of the printing paper from a paper kind entry key 149 serving as a paper kind input operation unit on a control panel 147 or from a paper kind detecting device 151, and information on the size of the printing paper from a paper size entry key 153 serving as a paper size input operation unit on the control panel 147 or from a paper size detecting device 155, and store the received information in the RAM 205. The CPU 201 further reads control commands for the cam drive motor 139 according to the presence of a sorter, and the kind and size of the printing paper from the data files stored in the ROM 203, and supplies the control commands for the cam drive motor 139 to the motor drive circuit 157 for the cam drive motor 139. On-off signals from two limit switches 161 and 163 which are actuated by a switch actuation cam 159 mounted on the cam shaft 93 are also supplied to the CPU 201, and the CPU 201 carries out a feedback control of the rotation of the cam shaft 93 by detecting the angular rotation of the cam shaft 93 to any one of the first, second and third angular positions according to the combination of the on-off signals from the two limit switches 161 and 163.

The cam drive motor 139 operates according to whether a sorter 59 is connected to the printing device or not. If a sorter 59 is not connected to the printing device, the cam drive motor 139 operates according to the kind of the printing paper P entered from the paper kind input key 149 or detected by the paper kind detecting device 151, and according to the size of the printing paper P entered from the paper size input key 153 or detected by the paper size detecting device 155, and rotatively drive the cam shaft 93 to any one of the first, second and third angular positions according to the kind and size of the printing paper P.

The angular rotation of the cam shaft 93, which is carried out according to whether a sorter is connected or not, the kind of the printing paper P entered from the paper kind input key 149 or detected by the paper kind detecting device 151, and according to the size of the printing paper P entered from the paper size input key 153 or detected by the paper size detecting device 155, selectively produces any one of the first state in which the primary lifting members 85, the secondary lifting plates 99 and the roller support arm 113 along with the central lifting roller 109 are all at their lower positions as shown in FIG. 5, the second state in which the primary lifting members 85 and the roller support arm 113 along with the central lifting roller 109 are placed at their upper positions while the secondary lifting plates 99 are placed at their lower positions as shown in FIG. 6, and the third state in which the primary lifting members 85 and the secondary lifting plates 99 are placed at their upper positions while the roller support arm 113 and the central lifting roller 109 are placed at their lower positions as shown in FIG. 7.

As a result, when a sorter 59 is connected to the printing device, without regard to the kind and size of the printing paper P, the first state is achieved in which the primary lifting members 85, the secondary lifting plates 99 and the roller support arm 113 along with the central lifting roller 109 are all at their lower positions as shown in FIG. 5, and the printing paper P conveyed and ejected by the endless belt 83 is moved onto the belt conveyer 63 of the sorter 59 so as to be further conveyed by each of the bins 61 without being obstructed by the primary lifting members 85, the secondary lifting plates 99 and the central lifting roller 109.

On the other hand, when no sorter is connected to the printing device, the heights of the primary lifting members 85, the secondary lifting plates 99, the roller support arm 113, and the central lifting roller 109 are appropriately determined according to the kind and size of the printing paper P that is being used, and stable printing paper ejection is ensured at all times.

The paper size detecting device 155 may consist of a device for photoelectrically detecting the size of the printing paper P as it is being fed or ejected. If the paper feeding is carried out by using cassettes, the kind of the cassette may be photoelectrically or magnetically detected.

Figure 10:
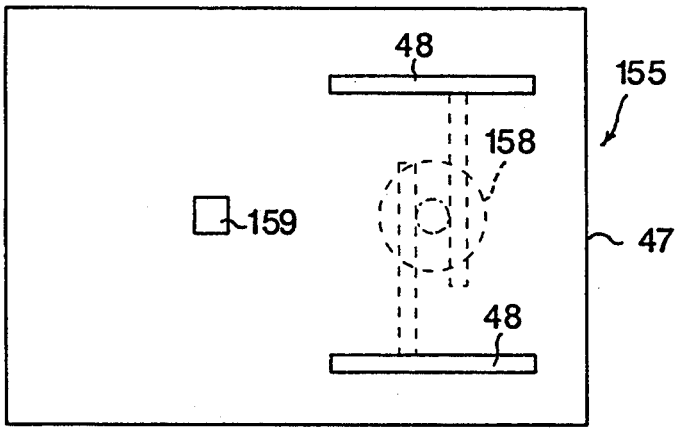
FIG. 10 is a plan view of an embodiment of the paper size detecting device.

FIG. 10 illustrates an example of the paper size detecting device 155 which comprises a printing paper size detecting switch 159 consisting of a limit switch, a photoelectric switch or the like mounted on a prescribed location of the paper feeding table 47, and the size of the printing paper P mounted on the paper feeding table 47 is detected, electromechanically or photoelectrically, by the printing paper size detecting switch 159 selectively contacting the printing paper P or being selectively covered by the printing paper P.

If the paper feeding table 47 is provided with a paper feed side fences 48, the printing paper size detecting device 155 may consist of a potentiometer 158 which is turned in association with the movement of the paper feed side fences 48.

Figure 11:
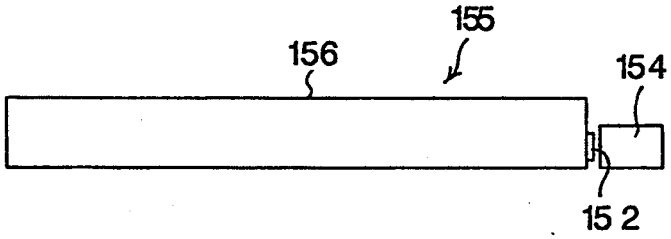
FIG. 11 is an end view of an alternate embodiment of the paper size detecting device.

If the paper feeding unit 43 employs different paper cassettes for printing paper of different sizes, as illustrated in FIG. 11, each paper cassette 156 may be provided with a mark 152 consisting of a bar code or the like that can be photoelectrically read so as to indicate the printing paper size so that the paper size may be detected by a photoelectric sensor 154 for photoelectrically reading the mark 152 from the particular paper cassette 156 that is fitted into the paper feeding unit 43.

The paper kind detecting device 151 may consist of a switch associated with the paper feeding pressure selection lever which is pre-set according to the kind of paper that is placed in the paper feeding unit.

Figure 12:
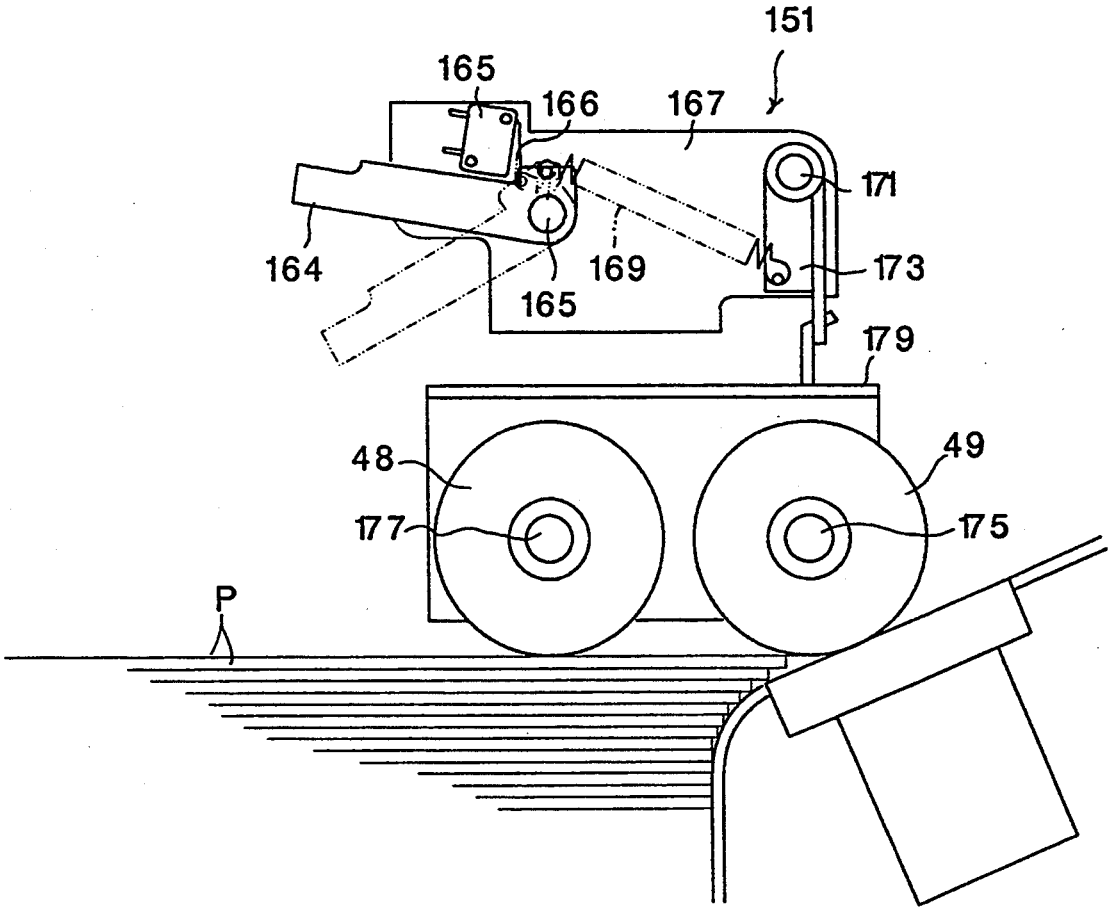
FIG. 12 is a side view of an embodiment of the paper kind detecting device which is capable of automatically detecting the thickness of the printing paper.
Figure 9:
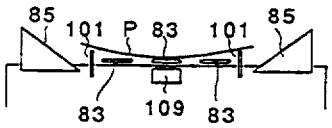
Figure 9:
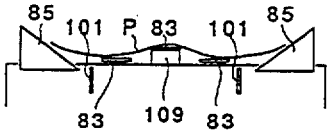
Figure 9:
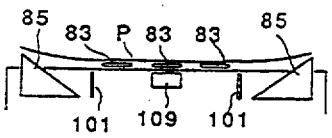

FIG. 12 illustrates an example of the paper kind detecting device 151 which is adapted to be mounted in the paper feeding unit 43. This paper kind detecting device 151 comprises a limit switch 165 which is turned on and off according to the selected position of a paper feeding pressure selection lever 164 provided in the paper feeding unit 43.

The paper feeding pressure selection lever 164 is mounted on a fixed support plate 167 via a pivot shaft 165 so as to be rotatable between a standard paper position indicated by the solid lines in FIG. 12 and a thick paper position indicated by the imaginary lines in FIG. 12, and actuates the limit switch 165 by contacting an actuation member 166 of the limit switch 165 when the paper feeding pressure selection lever 164 is positioned to the thick paper position.

An end of a tension coil spring 169 for applying a paper feeding pressure is engaged to the paper feeding pressure selection lever 164 while the other end of the tension coil spring 169 is engaged to a rotary lever member 173 rotatably supported by the fixed support plate 167 via a pivot shaft 171. As a result, when the paper feeding pressure selection lever 164 is turned from the standard paper position to the thick paper position, the spring force urging the rotary lever member 173 in clockwise direction as seen in the drawing is increased, and the urging force or the paper feeding pressure applied to a roller support member 179 directed in counter clockwise direction or downward as seen in the drawing is increased. The roller support member 179 is vertically rotatably supported by a support shaft 175 which also supports the paper separation roller 49, and additionally rotatably supports the paper feed roller 48 via a roller shaft 177.

According to this structure, as the operator changes the setting of the paper feeding pressure selection lever 164 depending on the kind of the printing paper or whether it is standard paper or thick paper, the corresponding state of the limit switch 165 sends an appropriate signal to the CPU 201. Therefore, the operator is not required to do any extra work to change the setting of the lifting members, but the CPU 201 ensures that are all appropriately position depending on the kind of the printing paper that is used. Thus, a smooth paper ejecting operation is ensured at all times.

In the above described embodiment, the primary lifting members 85, the secondary lifting members 99, the roller support arms 113 and the central lifting roller 109 were positioned either at their upper positions or at their lower positions, but may also be adapted to be placed at intermediate positions so that the paper ejection device may be adapted to intermediate paper sizes and paper kinds, and can thereby cover a wider range of printing papers. Also, the primary lifting members 85, the secondary lifting members 99, the roller support arms 113 and the central lifting roller 109 may be actuated separately by separate servo motors.

As can be understood from the above description, according to the paper ejection device for a stencil printing device of the present invention, a control unit which may consist of a CPU receives information on the presence of a sorter, the kind of the printing paper and/or the size of the printing paper, and places the moveable lifting members at their lower positions by drive means when a sorter is indeed connected to the printing device or at other appropriately positions depending on the nature of the printing paper. Therefore, the lifting members are placed in an appropriate manner depending on the presence of a sorter and the kind and size of the printing paper without requiring any manual replacement of the lifting member so that a stable paper ejection is ensured at all times.

Although the present invention has been described in terms of preferred embodiments thereof, it is obvious to a person skilled in the art that various alterations and modifications are possible without departing from the scope of the present invention which is set forth in the appended claims.

What we claim is:

1. A paper ejection device for a stencil printing device, comprising:

a lifting member provided in an intermediate part of a paper ejection passage of said stencil printing device for producing a curvature in each sheet of printing paper as seen in a cross section perpendicular to the direction of paper ejection;

lifting member support means for supporting said lifting member in a substantially vertically moveable manner at least between a first position which is retracted from said paper ejection passage and a second position which protrudes into said paper ejection passage;

drive means for moving said lifting member at least between said first and second positions; and control means for controlling the operation of said drive means according to a signal supplied from information receiving means.

2. A paper ejection device according to claim 1, wherein said information receiving means comprises a manual switch adapted to be used by an operator of said stencil printing device.

3. A paper ejection device according to claim 2, wherein said manual switch is incorporated in a paper type selection switch of said stencil printing device.

4. A paper ejection device according to claim 2, wherein said manual switch is incorporated in a paper size selection switch of said stencil printing device.

5. A paper ejection device according to claim 1, wherein said information receiving means comprises a sorter sensor for detecting whether a sorter is connected to said paper ejection passage or not, and said driving means moves said lifting member to said first position when a sorter is connected to said paper ejection passage and to said second position when a sorter is not connected to said paper ejection passage.

6. A paper ejection device according to claim 1, wherein said information receiving means comprises a sensor for detecting the type of a sheet of printing paper that is to be ejected from said stencil printing device.

7. A paper ejection device according to claim 1, wherein said information receiving means comprises a sensor for detecting the size of a sheet of printing paper that is to be ejected from said stencil printing device.

* * * * *

UNITED STATES PATENT AND TRADEMARK OFFICE

CERTIFICATE OF CORRECTION

PATENT NO. : 5,404,805
DATED : April 11, 1995
INVENTOR(S) : Fujimoto, et al.

Figure 9:
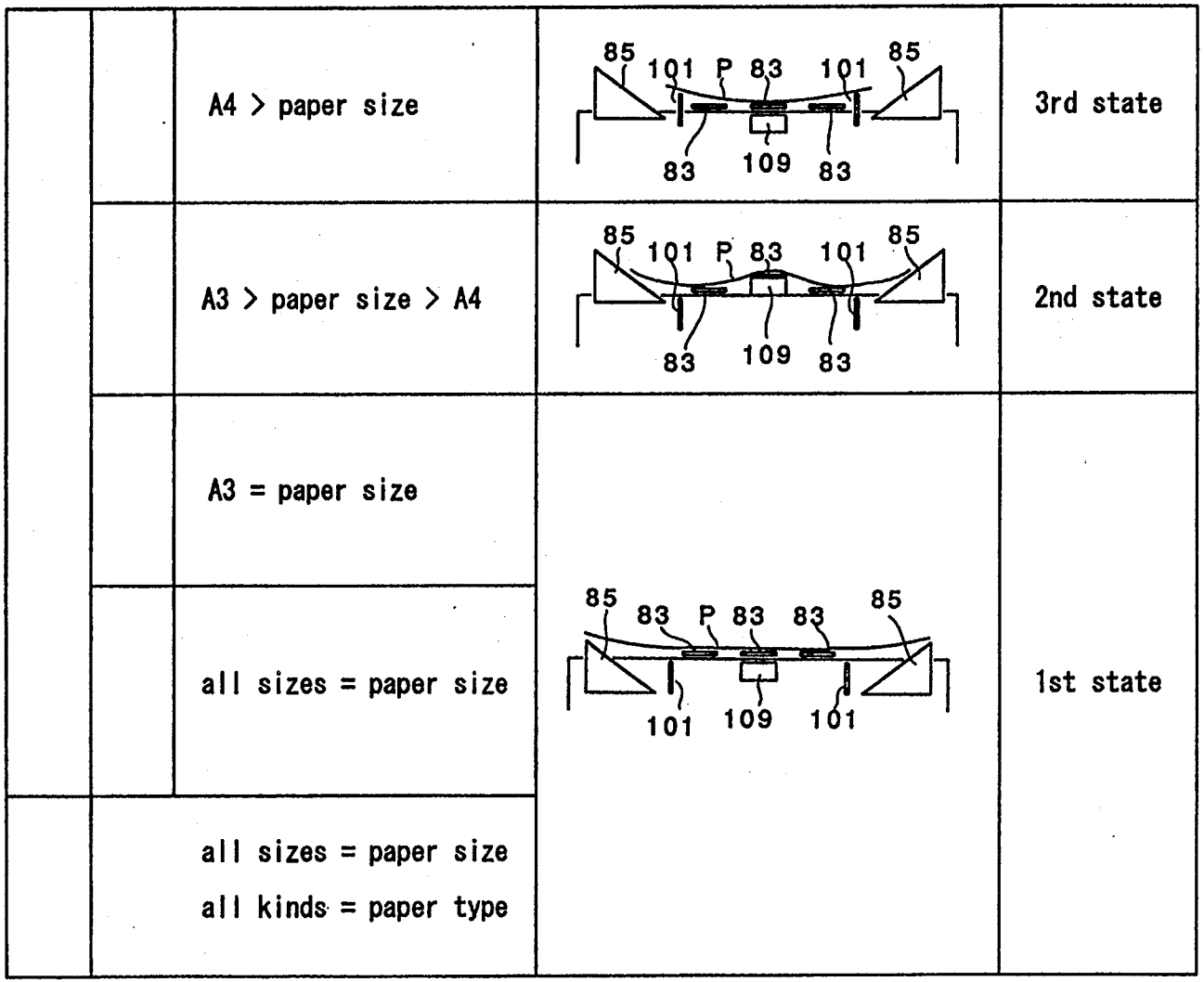
FIG. 9 is a diagram showing the operation of the different modes of the paper ejection device for a stencil printing device according to the present invention.

It is certified that error appears in the above-indentified patent and that said Letters Patent is hereby corrected as shown below:

Delete Drawing Sheet 9 and substitute therefor the Drawing Sheet consisting of FIG. 9, as shown on the attached page.

Signed and Sealed this

Fifth Day of September, 1995

*Attest:*

Bruce Lehman

BRUCE LEHMAN

*Attesting Officer*

*Commissioner of Patents and Trademarks*

| | | | | |
|---|---|---|---|---|
| sorter not connected | standard paper | A4 > paper size |  | 3rd state |
| | standard paper | A3 > paper size > A4 |  | 2nd state |
| | standard paper | A3 = paper size |  | 1st state |
| | thick paper | all sizes = paper size | | |
| sorter connected | | all sizes = paper size<br>all kinds = paper type | | |